US007992961B2

(12) United States Patent
Chikamoto et al.

(10) Patent No.: US 7,992,961 B2
(45) Date of Patent: Aug. 9, 2011

(54) INK-JET HEAD

(75) Inventors: Tadanobu Chikamoto, Nagoya (JP); Hiroshi Taira, Ichinomiya (JP); Yoshirou Kita, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 1137 days.

(21) Appl. No.: 11/690,830

(22) Filed: Mar. 25, 2007

(65) Prior Publication Data

US 2007/0229580 A1 Oct. 4, 2007

(30) Foreign Application Priority Data

Mar. 31, 2006 (JP) ..... 2006-097260

(51) Int. Cl.
*B41J 2/165* (2006.01)

(52) U.S. Cl. ..... 347/29; 347/84

(58) Field of Classification Search ..... 347/29; 355/97

See application file for complete search history.

(56) References Cited

U.S. PATENT DOCUMENTS 3,926,360 A * 12/1975 Moister, Jr. ..... 228/180.21
5,117,244 A * 5/1992 Yu ..... 347/29
5,539,447 A * 7/1996 Akuta et al. ..... 347/263
5,610,644 A * 3/1997 Timm et al. ..... 347/87
5,684,521 A * 11/1997 Salter et al. ..... 347/87
5,781,208 A * 7/1998 Karita et al. ..... 347/29
5,867,184 A * 2/1999 Quintana ..... 347/29
5,936,647 A * 8/1999 Rhodes et al. ..... 347/29
5,953,042 A * 9/1999 Nabeta et al. ..... 347/263
5,956,053 A * 9/1999 Michael ..... 347/29
6,010,202 A * 1/2000 Arnott ..... 347/10
6,135,585 A * 10/2000 Johnson et al. ..... 347/32
6,142,602 A * 11/2000 Tanaka ..... 347/29
6,151,043 A * 11/2000 Michael et al. ..... 347/29
6,183,060 B1 * 2/2001 Tokuda ..... 347/33
6,196,658 B1 * 3/2001 Rhodes et al. ..... 347/29
6,276,778 B1 * 8/2001 Katayama ..... 347/28
6,286,950 B1 * 9/2001 Altendorf et al. ..... 347/86
6,312,091 B1 * 11/2001 Quintana ..... 347/29
6,362,868 B1 * 3/2002 Silverbrook ..... 355/18
6,471,331 B1 * 10/2002 Silverbrook et al. ..... 347/32
6,637,856 B2 * 10/2003 Nishi et al. ..... 347/29
6,679,595 B2 * 1/2004 Yamada et al. ..... 347/87
6,732,433 B2 * 5/2004 Sleger ..... 29/890.1

(Continued)

FOREIGN PATENT DOCUMENTS

JP 04014461 A * 1/1992

(Continued)

*Primary Examiner* — Charlie Peng
*Assistant Examiner* — Peter Radkowski
(74) *Attorney, Agent, or Firm* — Baker Botts L.L.P.

(57) ABSTRACT

A passage unit formed with ink ejection ports, an actuator mounted on the passage unit, and a cover member are provided. Further provided is a side plate member that is in contact with a mounting face of the passage unit on which the actuator is mounted. The side plate member has a side plate and an opposing plate that is connected to the side plate. The side plate extends in the longitudinal direction of the passage unit and along a contour line of the passage unit. The side plate is in crosswise contact with the mounting face. The opposing plate is opposed to the mounting face. The cover member is placed at such a position that the actuator and the side plate member are sandwiched between the cover member and the passage unit. The cover member presses the opposing plate toward the passage unit.

13 Claims, 10 Drawing Sheets

U.S. PATENT DOCUMENTS 6,860,581 B2 * 3/2005 Silverbrook et al. ..... 347/29
6,918,647 B2 * 7/2005 Silverbrook ..... 347/22
6,918,649 B2 * 7/2005 Silverbrook et al. ..... 347/29
6,938,980 B2 * 9/2005 Yakura et al. ..... 347/29
7,021,749 B2 * 4/2006 Akahane et al. ..... 347/68
7,077,496 B2 * 7/2006 Silverbrook ..... 347/29
7,083,257 B2 * 8/2006 Silverbrook et al. ..... 347/42
7,110,139 B2 * 9/2006 Silverbrook ..... 358/1.8
7,149,090 B2 * 12/2006 Suzuki et al. ..... 361/762
7,156,511 B2 * 1/2007 Silverbrook et al. ..... 347/86
7,303,264 B2 * 12/2007 Bibl et al. ..... 347/68
7,360,850 B2 * 4/2008 Silverbrook ..... 347/2
7,419,237 B2 * 9/2008 Suzuki ..... 347/18
7,654,697 B2 * 2/2010 Yoshimura et al. ..... 362/294
2001/0001559 A1 * 5/2001 Rhodes et al. ..... 347/29
2002/0008726 A1 * 1/2002 Tsuchiya et al. ..... 347/29
2002/0105567 A1 * 8/2002 Yamada et al. ..... 347/87
2002/0140752 A1 * 10/2002 Pulman et al. ..... 347/10
2002/0140764 A1 * 10/2002 Silverbrook et al. ..... 347/29
2003/0030704 A1 * 2/2003 Sakamoto et al. ..... 347/68
2003/0038857 A1 * 2/2003 Yamamoto et al. ..... 347/29
2003/0063449 A1 * 4/2003 Suzuki et al. ..... 361/777
2003/0202051 A1 * 10/2003 Ito et al. ..... 347/68
2003/0206217 A1 * 11/2003 Sleger ..... 347/63
2004/0090485 A1 * 5/2004 Silverbrook et al. ..... 347/29
2004/0183867 A1 * 9/2004 Hirota ..... 347/68
2004/0189730 A1 * 9/2004 Kubo ..... 347/18
2004/0207292 A1 * 10/2004 Scher et al. ..... 310/328
2005/0093918 A1 * 5/2005 Silverbrook et al. ..... 347/29
2005/0134631 A1 * 6/2005 Silverbrook ..... 347/29
2005/0156994 A1 * 7/2005 Silverbrook et al. ..... 347/29
2005/0157104 A1 7/2005 Hirota et al.
2005/0162459 A1 * 7/2005 Silverbrook et al. ..... 347/29
2005/0174381 A1 * 8/2005 Silverbrook et al. ..... 347/29
2006/0028504 A1 * 2/2006 Silverbrook et al. ..... 347/29
2006/0044363 A1 * 3/2006 Katayama ..... 347/71
2006/0087532 A1 * 4/2006 Takata et al. ..... 347/50
2006/0250451 A1 * 11/2006 Suzuki et al. ..... 347/58
2008/0143798 A1 * 6/2008 Silverbrook ..... 347/86

FOREIGN PATENT DOCUMENTS

JP 2005169839 A 6/2005

* cited by examiner

INK-JET HEAD

CROSS-REFERENCE TO RELATED APPLICATION

This application claims priority to and the benefit of Japanese Patent Application No. 2006-097260, which was filed on Mar. 31, 2006, the disclosure of which is incorporated herein by reference.

BACKGROUND OF THE INVENTION

1. Field of the Invention

The present invention relates to an ink-jet head that performs printing by ejecting ink droplets.

2. Description of Related Art

Some of ink-jet heads that eject ink droplets to recording media include a passage unit and an actuator. The passage unit has individual ink passages each extending from a common ink chamber through a pressure chamber to a nozzle. The actuator applies ejection energy to the pressure chamber, for ejecting an ink droplet from the nozzle. Used as the actuator is, for example, one in which a piezoelectric layer made of a lead zirconate titanate (PZT)-base ceramic material having ferroelectricity is sandwiched between individual electrodes each corresponding to each pressure chamber and a common electrode set at the ground potential. When a splash of ink adheres to such an actuator, a short circuit may undesirably be caused between individual electrodes that are disposed on a surface of the actuator. Thus, as a known technique for preventing a splash of ink from adhering to an actuator, a covering is mounted on a passage unit (see Japanese Patent Unexamined Publication No. 2005-169839, FIG. 3, for example).

In terms of restraining a splash of ink from entering an ink-jet head, it is preferable that an end face of a covering and a passage unit are in perfect contact with each other. However, due to influence of a manufacturing tolerance of the covering or the like, a gap may appear between the end face of the covering and the passage unit. If there is a gap between the end face of the covering and the passage unit, a splash of ink may go through the gap into the ink-jet head and adhere to an actuator. If the gap is large, it is difficult to seal the gap by use of a sealant.

SUMMARY OF THE INVENTION

An object of the present invention is to provide an ink-jet head that can prevent a splash of ink from entering the ink-jet head.

According to an aspect of the present invention, there is provided an ink-jet head including a passage unit, an actuator, at least one side plate member, and a cover member. The passage unit has an ink ejection face on which ink ejection ports that eject ink droplets are formed. The actuator is mounted on a mounting face of the passage unit which is opposite to the ink ejection face, and generates ejection energy for ejecting ink droplet from the ink ejection port. The at least one side plate member has a side plate and an opposing plate. The side plate extends in a longitudinal direction of the passage unit along a contour line of the passage unit, and is in contact with the mounting face in such a manner as to perpendicularly cross the mounting face. The opposing plate is connected to the side plate and opposed to the mounting face. The cover member is placed at such a position that the actuator and the side plate member are sandwiched between the cover member and the passage unit. The cover member is disposed so as to press the opposing plate of the side plate member toward the passage unit.

In the aspect, the cover member is disposed so as to press the opposing plate of the side plate member toward the passage unit, thereby surely bringing an end portion of the side plate into contact with the mounting face of the passage unit. Consequently, little gap appears between the mounting face of the passage unit and the side plate member. Therefore, a splash of ink cannot go through a gap between the mounting face of the passage unit and the side plate member so that a splash of ink is prevented from adhering to the actuator. Accordingly, even when there is an error in positional relation between the opposing plate of the side plate member and the cover member due to a manufacturing tolerance of the cover member and/or the side plate member or the like, the end portion of the side plate can surely be in contact with the mounting face of the passage unit by making the cover member surely press the opposing plate.

BRIEF DESCRIPTION OF THE DRAWINGS

Other and further objects, features and advantages of the invention will appear more fully from the following description taken in connection with the accompanying drawings in which.

DESCRIPTION OF THE PREFERRED EMBODIMENTS

Figure 1:
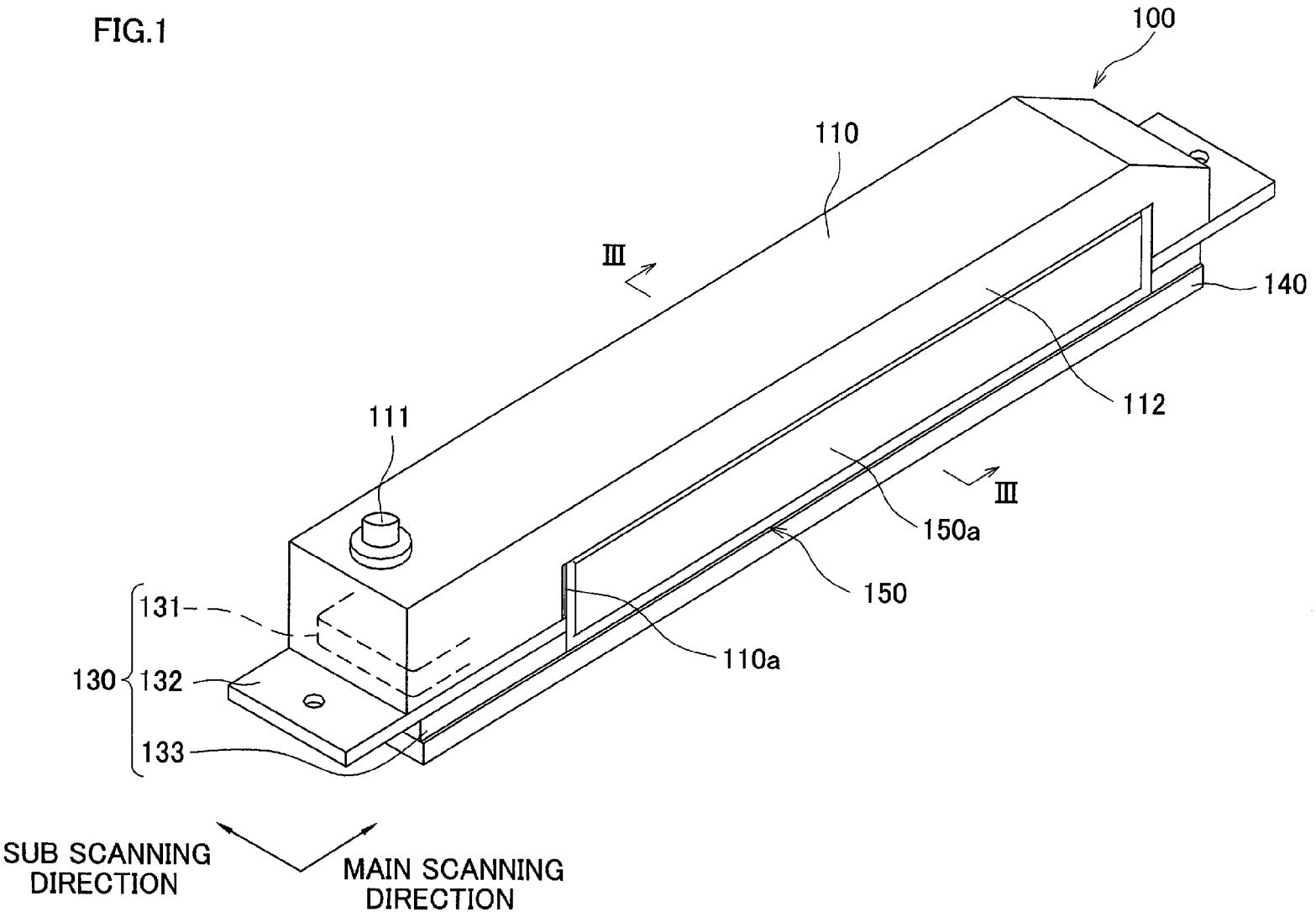
FIG. 1 is a schematic perspective view of an ink-jet head according to an embodiment of the present invention.
Figure 2:
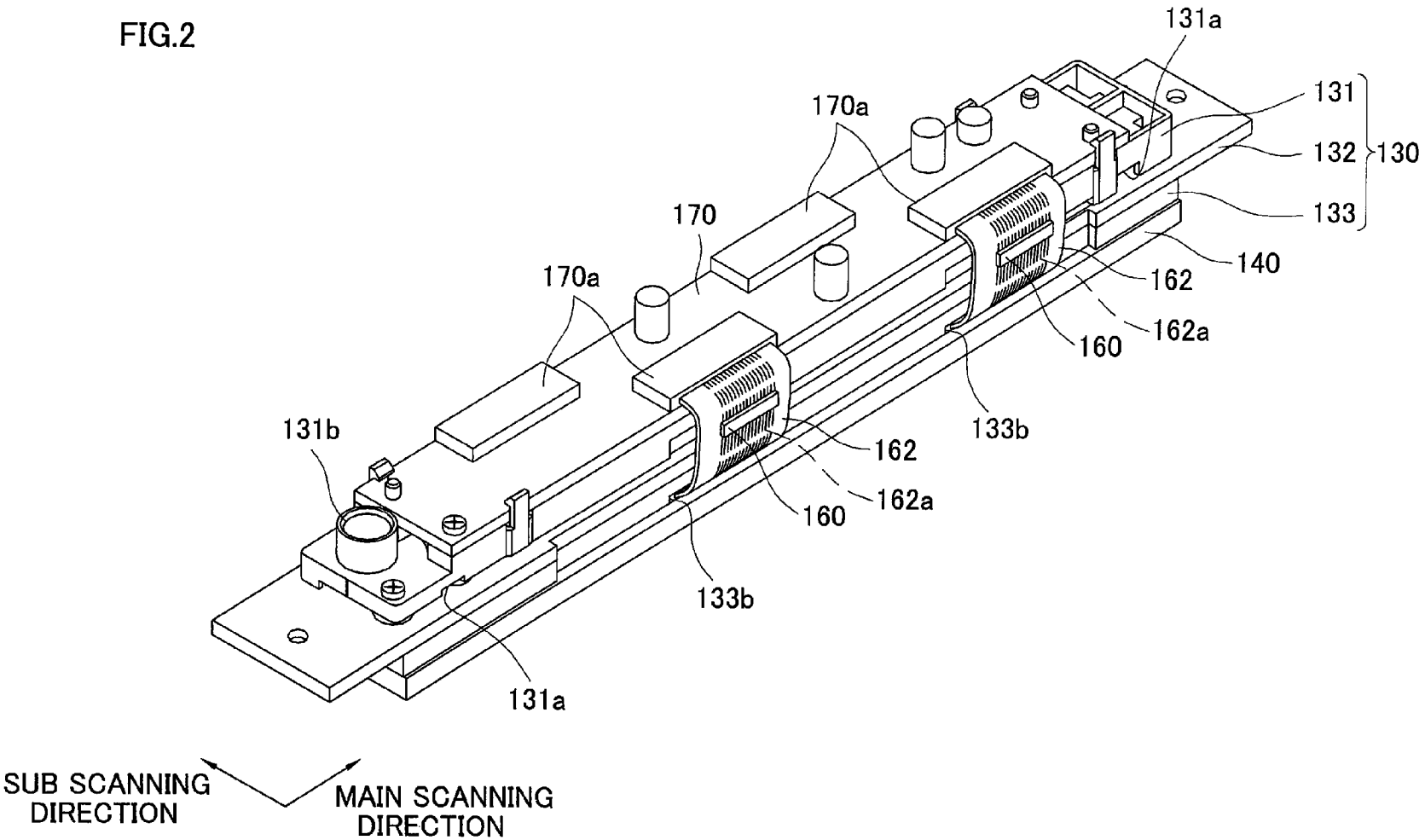
FIG. 2 is a perspective view showing an internal construction of the ink-jet head 1 shown in FIG. 1.
Figure 3:
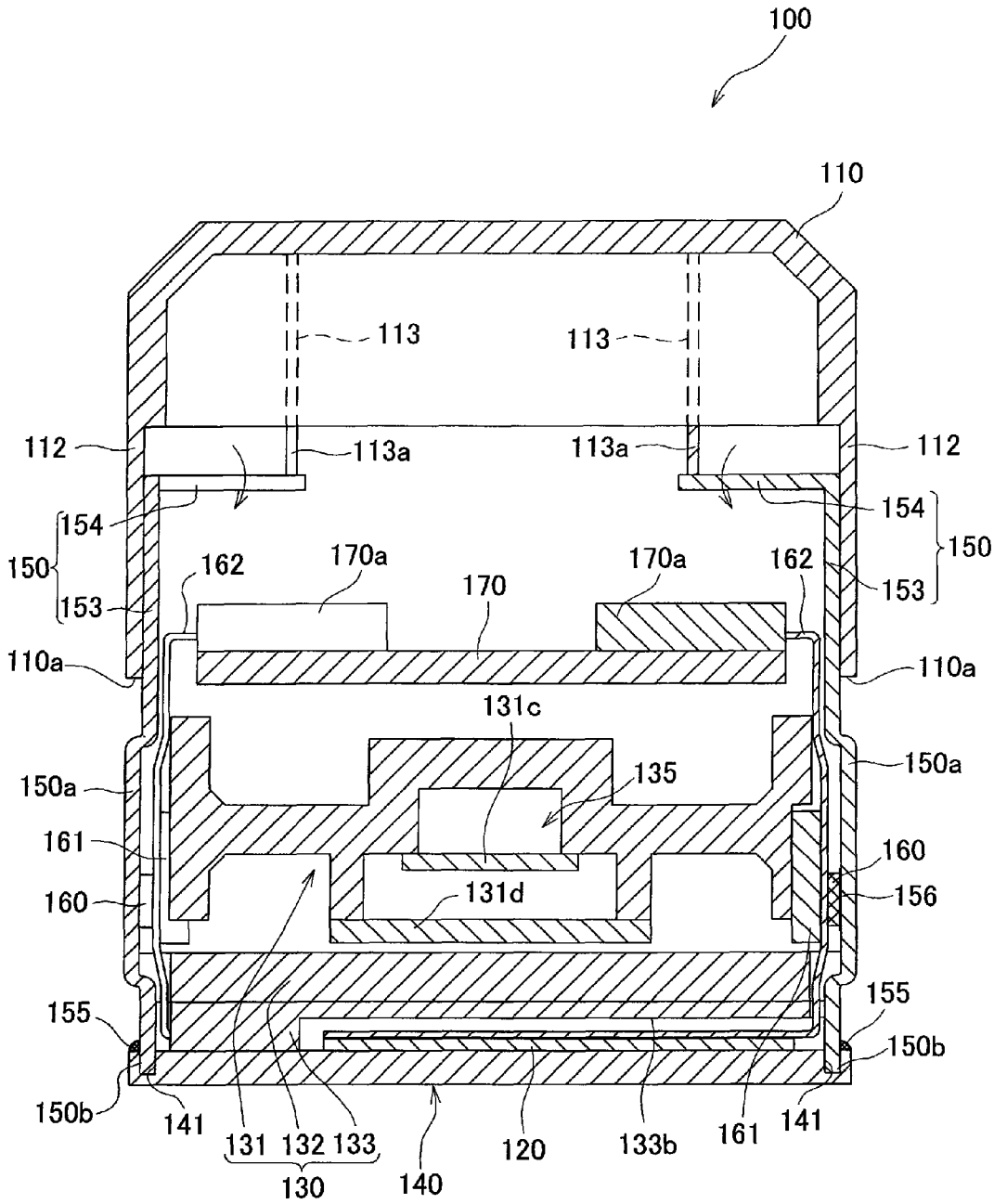
FIG. 3 shows a cross section as taken along line III-III in FIG. 1.

In the following, a certain preferred embodiment of the present invention will be described with reference to the accompanying drawings. FIG. 1 is a schematic perspective view of an ink-jet head 100 according to an embodiment of the present invention. FIG. 2 is a perspective view of the ink-jet head 100 from which a head covering 110 and a heat sink 150 have been removed. FIG. 3 shows a cross section as taken along line III-III in FIG. 1. The ink-jet head 100 is applicable to all of character/image recording apparatuses of ink-jet type, such as an ink-jet printer. In a plan view, the ink-jet head 100 is elongated in one direction. Here, in this embodiment, a main scanning direction means a direction of elongation of the ink-jet head 100 in a plan view, and a sub scanning direction means a direction perpendicular to the main scanning direction in a plan view. In addition, a downward direction means a direction in which an ink droplet is ejected from the ink-jet head 100, and an upward direction means a direction opposite to the downward direction.

As shown in FIGS. 1 to 3, the ink-jet head 100 has a passage unit 140, an ink reservoir 130, a head covering (i.e., a cover member) 110, a heat sink 150, and a control board 170. Openings of nozzles (i.e., ink ejection ports) 8 are formed on a lower face (i.e., ink ejection face) of the passage unit 140 (see FIG. 9). The ink reservoir 130 supplies ink to the passage unit 140. The control board 170, the ink reservoir 130, and the passage unit 140 are put in layers in this order from up to down.

Figure 4:
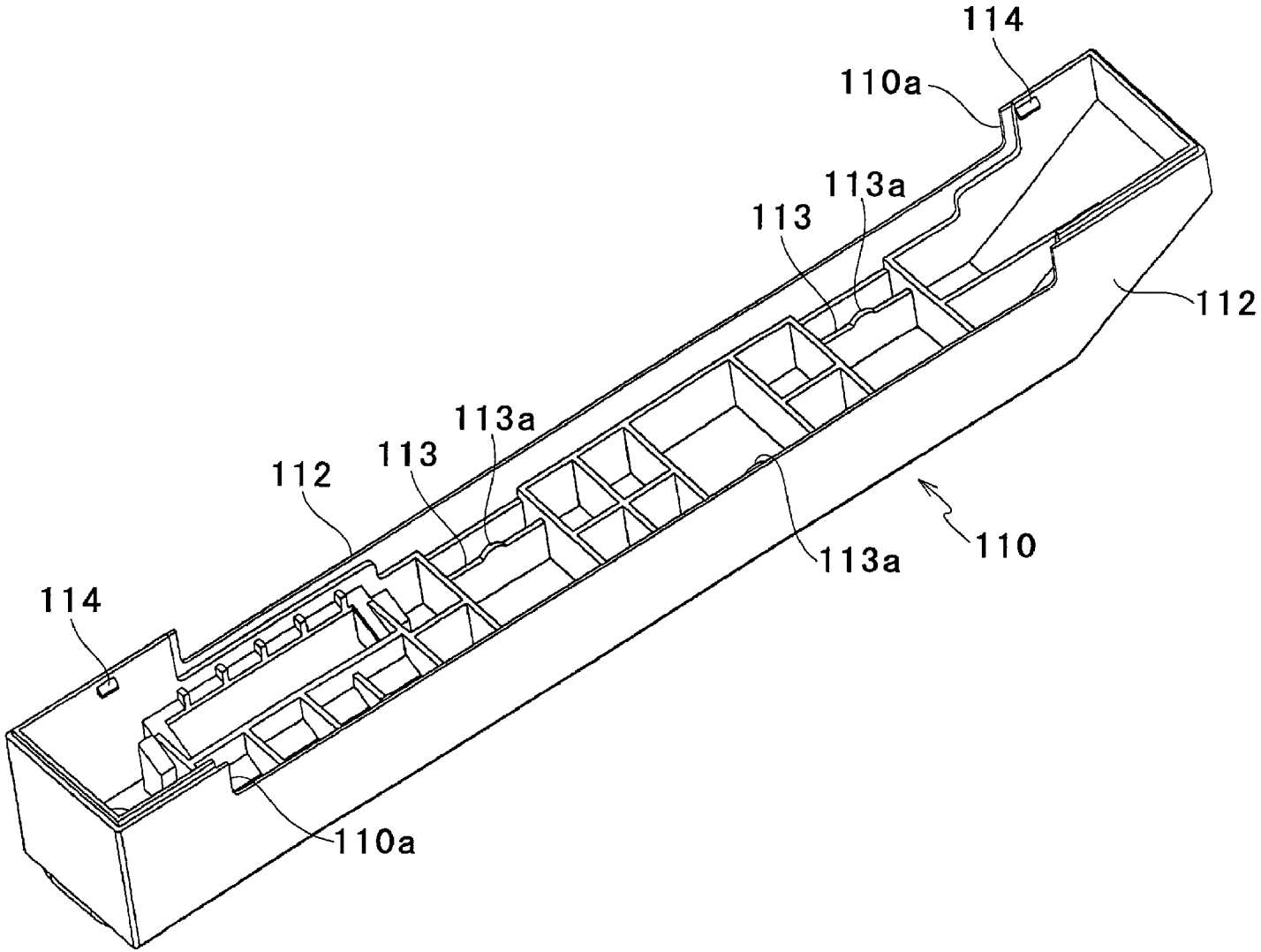
FIG. 4 is a perspective view of a head covering shown in FIG. 1.

The head covering 110 will be described with additional reference to FIG. 4. FIG. 4 is a perspective view of the head covering 110 as seen from a passage unit 140 side. As shown in FIGS. 1 and 4, the head covering 110 has a substantially box-like shape that opens downward, and is disposed so as to cover a space existing above the passage unit 140. An ink supply valve 111 is provided on an upper face of the head covering 110. Through the ink supply valve 111, ink is supplied to the ink reservoir 130. In addition, many ribs 113 are formed on an inner wall face of the head covering 110 which is opposed to the passage unit 140. The many ribs 113 are formed in a substantially grid-like manner. Actuator units 120 which will be described later are mounted on an upper face (i.e., mounting face) of the passage unit 140. The ribs 113 protrude down toward the mounting face. Presence of the ribs 113 serves to improve rigidity of the head covering 110. In addition, the rib 113 has, at its lower end portion, a distal end portion 113*a* that protrudes further downward. A cross section of the rib 113 including an axis in a protruding direction of the rib 113 has its contour curved.

The head covering 110 includes side plates (i.e., cover side plates) 112 that extend in an up-and-down direction toward both widthwise edges of the passage unit 140. Rectangular openings 110*a* extending in the main scanning direction are formed in the side plates 112. Each of the openings 110*a* is a notch reaching from a lower end of the side plate 112 to a vicinity of a center of the side plate 112 with respect to the up-and-down direction. The openings 110*a* are for exposing, through the head covering 110, flat protrusions (i.e., protrusion) 150 formed on the head sink 150 as will be described later.

Four projections 114 are formed on inner faces of the side plates 112. Two of the four projections 114 are formed on one side plate 112, and the other two of the four projections 114 are formed on the other side plate 112. FIG. 4 shows only two of the four projections 114. As shown in FIG. 2, four recesses 131*a* are formed on a lower face of an upper reservoir 131 which will be described later. FIG. 2 shows only two of the four recesses 131a. The recesses 131*a* are formed at positions corresponding to the respective projections 114. The head covering 110 is mounted on the ink-jet head 100 so as to make the four projections 114 fitted into the four recesses 131*a*. Thereby, the head covering 110 is fixed to the ink reservoir 130. Here, the head covering 110 may be fixed to the ink reservoir 130 with an adhesive.

As described above, as shown in FIG. 1, the head covering 110 has a top plate having the ink supply valve 111 mounted thereon, four side plates 112 extending downward from respective side edges of the top plate, and openings 110*a* formed in the two side plates 112 that extend in the main scanning direction (i.e., a longitudinal direction). The ribs 113 formed on an inner face of the plate divide an inner space in a substantially grid-like manner. In addition, a specific rib 113 has a distal end portion 113*a* of tapered shape. The distal end portion 113*a* protrudes further downward from a lower end face of the rib 113. In this embodiment, as shown in FIG. 4, every distal end portion 113*a* is formed on a lower end face of the rib 113 that extends along the main scanning direction.

Figure 5:
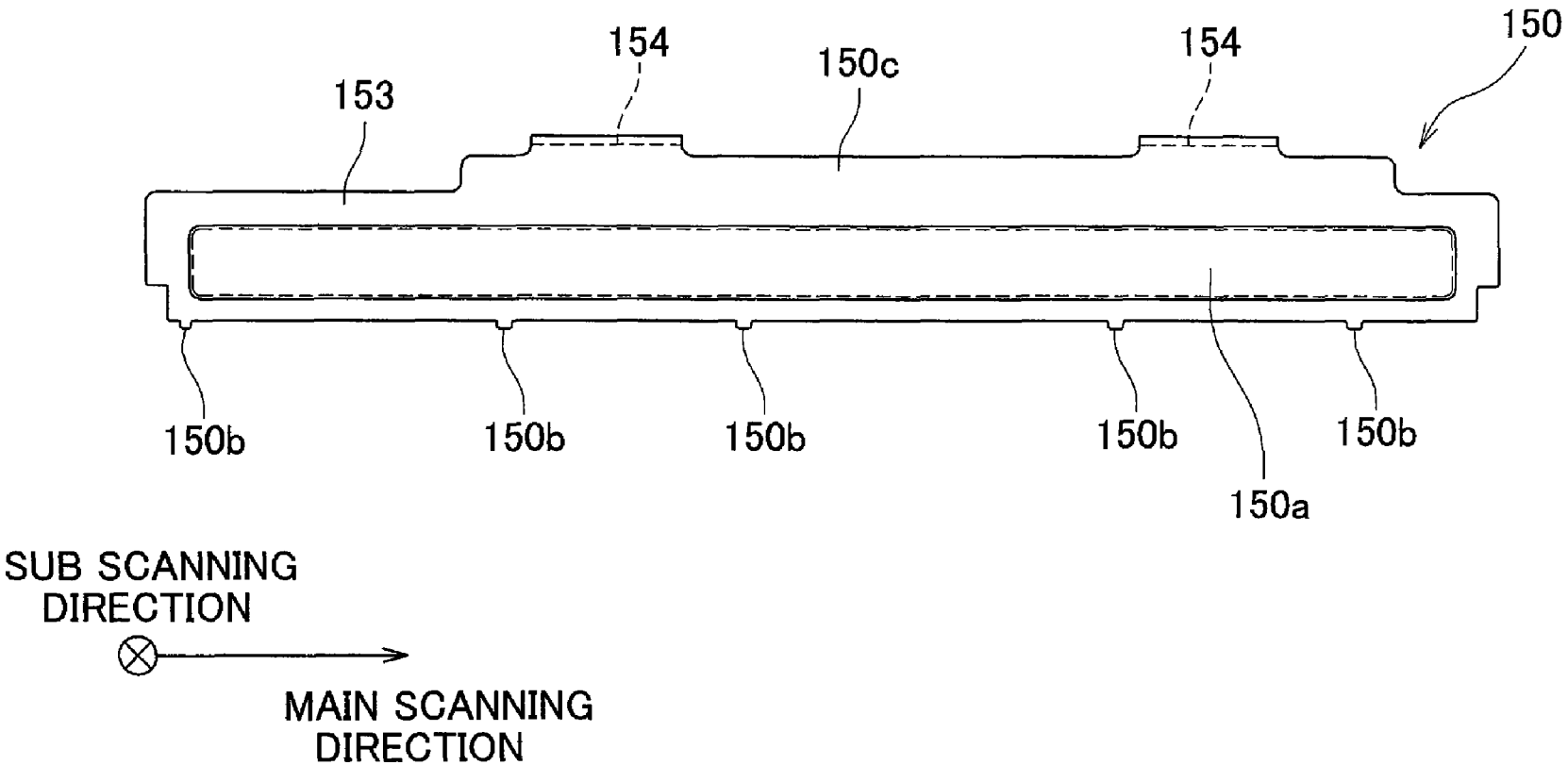
FIG. 5 is a side view of a heat sink shown in FIG. 1.

The heat sink 150 will be described with reference to FIGS. 1, 3, and 5. FIG. 5 is a side view of the heat sink 150. The heat sink 150 is a plate member made of an aluminum metal. The heat sink 150 includes a side plate 153 and two opposing plates 154. The side plate 153 has a substantially rectangular shape extending in a longitudinal direction of the passage unit 140 and also extending along a contour line of the passage unit 140. A lower end face of the side plate 153 is in contact with the upper face of the passage unit 140 in such a manner as to perpendicularly cross the upper face of the passage unit 140. A flat protrusion 150*a* of rectangular shape is formed in a middle of the side plate 153. The flat protrusion 150*a* extends in the longitudinal direction of the passage unit 140. As shown in FIG. 3, the flat protrusion 150*a* protrudes outward of the passage unit 140 with respect to the sub scanning direction (i.e., a widthwise direction). The flat protrusion 150*a* is formed by, for example, subjecting a metallic flat plate to press-working. Since the flat protrusion 150*a* is formed on the heat sink 150 like this, rigidity of the heat sink 150 is improved.

Figure 7:
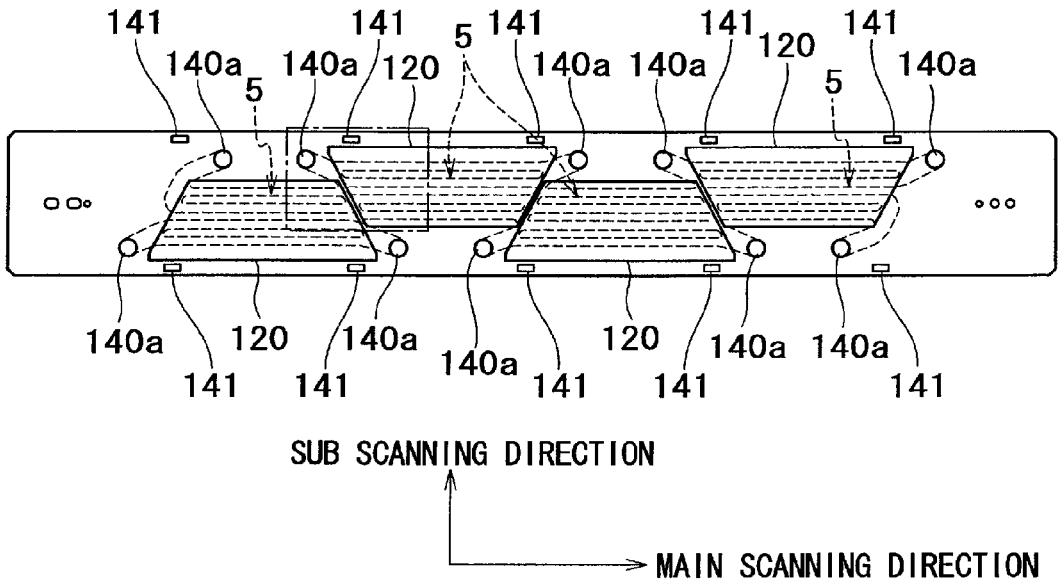
FIG. 7 is a plan view of a passage unit shown in FIG. 1.

As shown in FIG. 5, five projections 150*b* are formed at a lower end portion of the side plate 153. The five projections 150*b* protrude downward, and are arranged along the longitudinal direction. As will be described later, five recesses 141 are formed near each widthwise end of the passage unit 140, as shown in FIG. 7. The projections 150*b* are fitted in the respective recesses 141. Thereby, the heat sink 150 is standingly provided on the upper face of the passage unit 140. Two heat sinks 150 are opposed to each other with respect to a widthwise direction of the passage unit 140. As shown in FIG. 3, in a region of the side plate 153 above the flat protrusion 150*a*, an outer face of the side plate 153 (which means a face opposite to the opposing plate 154) and an inner face of the side plate 112 of the head covering 110 are in contact with each other.

The opposing plates 154 are connected to an upper end portion of the side plate 153, and extend inward from these connection points such that the opposing plates 154 is opposed to actuator units 120 mounted on the upper face of the passage unit 140. The distal end portions 113*a* of the ribs 113, which are formed on the head covering 110, press end portions of the opposing plates 154 distant from their connection points.

As a result, the opposing plates 154 are elastically deformed in directions indicated by arrows in FIG. 3, though opposing plates 154 thus deformed are not shown. The opposing plate 154 is displaced downward with the connection points between the opposing plate 154 and the side plate 153 acting as a fulcrum. Therefore, pressing force given by the rib 113 is divided into two components. One of the two components acts to press the side plate 153 onto the passage unit 140, that is, in a direction perpendicular to the mounting face. The other acts to press the opposing plate 154 onto the side plate 112 of the head covering 110, that is, in a direction parallel with the mounting face. Since the outer face of the side plate 153 and the inner face of the side plate 112 are in contact with each other, contact between the side plate 153 and the side plate 112 is improved. At the same time, contact between the side plate 153 and the passage unit 140 is improved, too.

Like this, the ribs 113 (and more specifically their distal end portions 113*a*) and the elastically-deformable opposing plates 154 constitute a kind of biasing means, which biases the heat sink 150 toward the protruding direction of the rib 113. In this embodiment, moreover, the head covering 110 functioning as a cover member has, at portions corresponding to outer widthwise edges of the passage unit 140, the side plates 112 that extend toward the mounting face of the passage unit 140 on which actuator units 120 are mounted. In addition, the distal end portion 113*a* of the rib 113 abuts on the heat sink 150, so that the heat sink 150 is at least deformed with the connection point between the opposing plate 154 and the side plate 153 functioning as a fulcrum and at the same time the side plate 153 is biased to the mounting face. A portion of the heat sink 150 in the vicinity of the connection point between the opposing plate 154 and the side plate 153 is supported in close contact with the inner face of the side plate 112 of the head covering 110.

Besides, in a plan view, a point of contact between the distal end portion 113*a* of the rib 113 and the opposing plate 154 overlaps the actuator unit 120. Like this, contact of the heat sink 150 with the passage unit 140 and the head covering 110 becomes higher in the vicinity of the actuator unit 120. Consequently, electrical malfunction such as a short circuit, which may be caused by intrusion of an ink droplet or an ink mist, can surely be prevented.

Although this embodiment adopts the heat sink 150 made of an aluminum metal, a material of a heat sink may be, for example, a titanium metal, a magnesium metal, a titanium-metal alloy, a magnesium-metal alloy, or an aluminum alloy.

In the ink-jet head 100, in order that a space surrounded by the head covering 110, the heat sink 150, the ink reservoir 130 (and particularly a reservoir base 132 which will be described later), and the passage unit 140 is made a sealed space, gaps between the respective members are sealed with potting materials 155. In the drawing, only the potting material 155 applied to a boundary region between the heat sink 150 and the passage unit 140 is shown. Here, the potting material does not go into the sealed space, because the heat sink 150 is in good contact with the passage unit 140 and the head covering 110.

The control board 170 controls the actuator units 120. As shown in FIGS. 2 and 3, the control board 170 is fixed above the ink reservoir 130. Four connectors 170*a* are fixed on an upper face of the control board 170. The connectors 170*a* are electrically connected to various processors and memory devices built on the control board 170. The four connectors 170*a* are arranged in two rows and in a zigzag pattern with respect to the main scanning direction.

One end of an FPC 162 is connected to a side face of each connector 170*a*. The FPC 162 is a flexible sheet member, and electrically connects the actuator unit 120 and the control board 170 to each other. Wires 162*a* are formed within the FPC 162. As shown in FIG. 2, the FPC 162 extends from the connector 170*a* downward along a side face of the ink reservoir 130, and passes through a recess 133*b* that is formed on the side face of the ink reservoir 130. Inside the recess 133*b*, the other end of the FPC 162 is electrically connected to the actuator unit 120. In addition, on the FPC 162, a driver IC 160 is mounted and electrically connected to the wires 162*a*.

The driver IC 160 is an IC chip that drives the actuator unit 120. As shown in FIG. 3, at a position opposed to the heat sink 150, a sponge 161 provided on the side face of the ink reservoir 130 biases the driver IC 160 as well as the FPC 162 to the heat sink 150. A heat dissipation sheet 156 is attached on an inner face of the heat sink 150 at a position opposed to the driver IC 160. The driver IC 160 is in close contact with the heat sink 150 with the heat dissipation sheet 156 interposed therebetween. Thereby, the driver IC 160 and the heat sink 150 are thermally coupled to each other.

Figure 6:
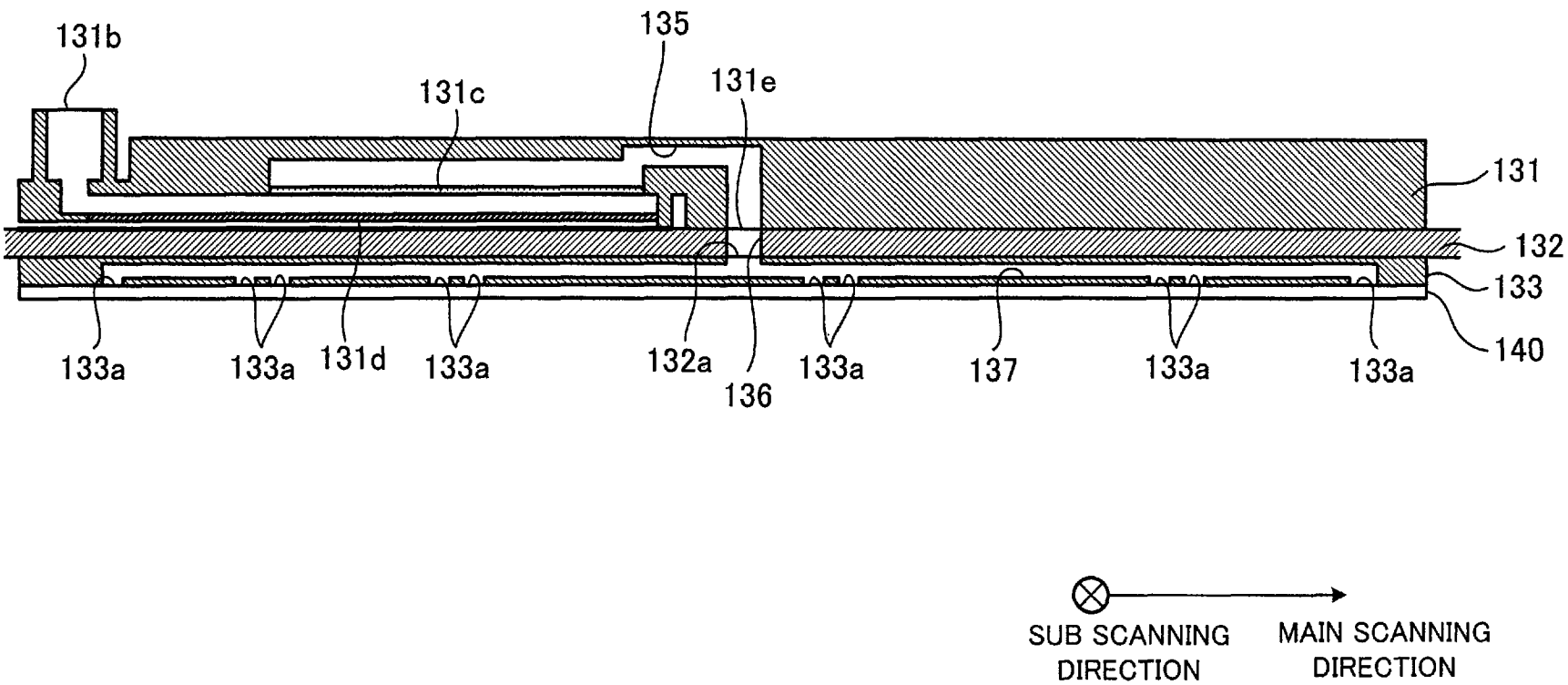
FIG. 6 shows a longitudinal cross section of an ink reservoir shown in FIG. 1.

Next, the ink reservoir 130 will be described in detail with reference to FIGS. 2, 3, and 6. FIG. 6 shows a longitudinal cross section of the ink reservoir 130 taken along both the main scanning direction and the up-and-down direction. As shown in FIGS. 2, 3, and 6, the ink reservoir 130 has an upper reservoir 131, a reservoir base 132, and a lower reservoir 133 in this order toward the passage unit 140. In a plan view, any of the upper reservoir 131, the reservoir base 132, and the lower reservoir 133 has a rectangular shape with its longer side extending in parallel with the main scanning direction.

As shown in FIG. 6, an ink passage 135 is formed within the upper reservoir 131. The ink passage 135 extends from an ink supply port 131*b* formed on an upper face of the upper reservoir 131, to an ink passage port 131e formed on a lower face of the upper reservoir 131. The ink supply port 131*b* locates near one end of the upper reservoir 131 with respect to the main scanning direction, and communicates with the ink supply valve 111 mounted on the upper face of the head covering 110. The ink passage port 131*e* is formed at a center of the upper reservoir 131 with respect to the main scanning direction and the sub scanning direction. The ink passage 135 is, in its lower face, partially made up of a flexible film 131*d*. A lower face of the film 131*d* is opposed to the reservoir base 132 with a predetermined space therebetween. The film 131*d* is disposed so as to be displaceable relative to the predetermined spaced. Accordingly, impact caused by a pressure wave that occurs in ink included in the ink passage 135 is absorbed due to vibration of the film 131*d*. Also, a filter 131*c* having pores is disposed within the ink passage 135.

An ink passage 136 is formed within the reservoir base 132. The ink passage 136 extends in the up-and-down direction from the ink passage port 131*e* to an ink passage port 132*a* that is formed on a lower face of the reservoir base 132. An ink passage 137 is formed within the lower reservoir 133. The ink passage 137 extends from the ink passage port 132*a* to several ink passage ports 133*a* that are formed on a lower face of the lower reservoir 133. The ink passage ports 133*a* communicate with later-described ink supply ports 140*a* that are formed on the upper face of the passage unit 140.

Through the ink passages 135 to 137 thus formed in the ink reservoir 130, ink supplied from the ink supply port 131*b* flows into the passage unit 140. Before reaching the passage unit 140, ink passes through the filter 131*c* provided in the ink passage 135. At this time, the filter 131*c* filters out impurities contained in the ink.

Figure 8:
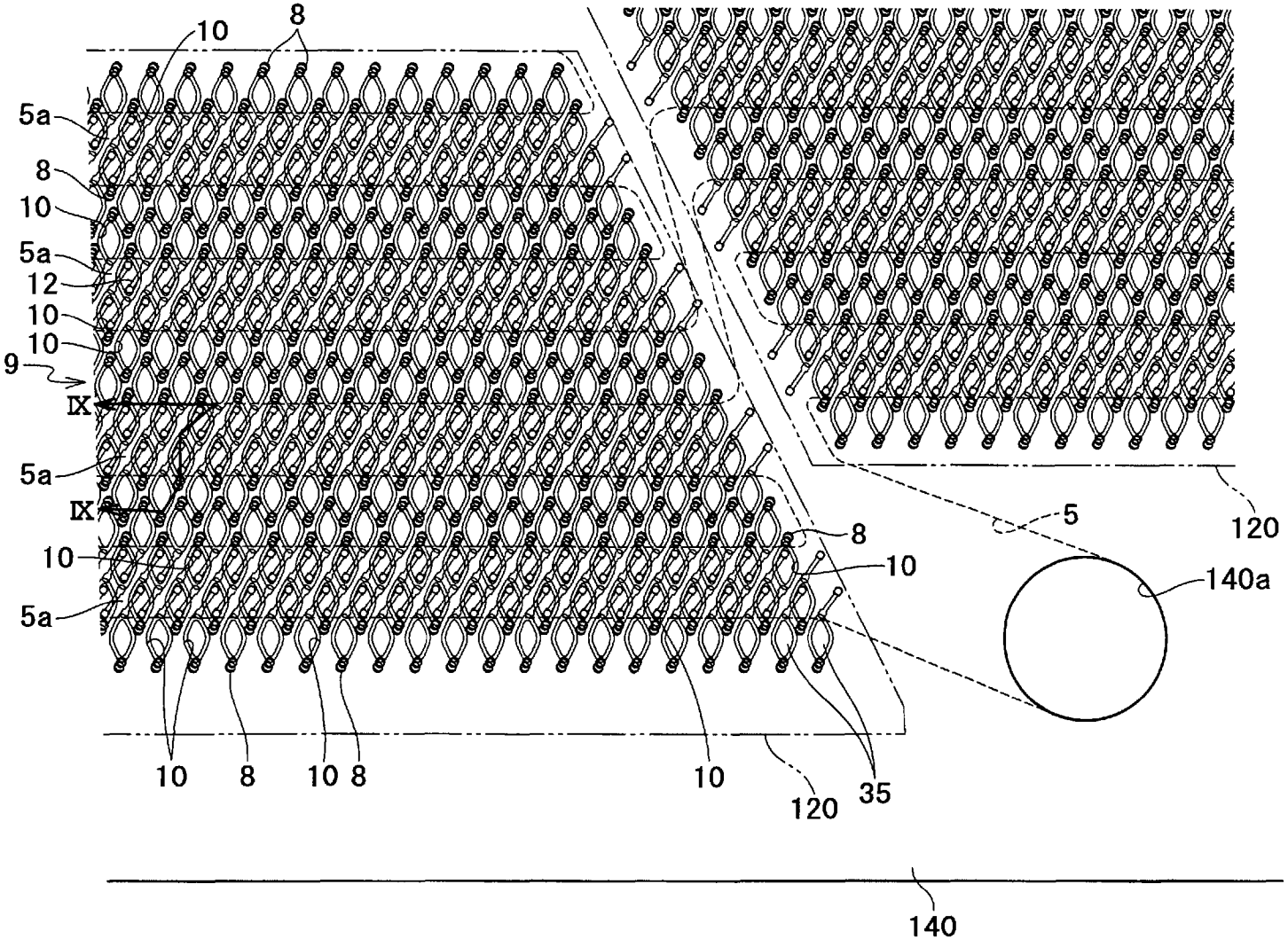
FIG. 8 is an enlarged plan view of a region enclosed with an alternate long and short dash line in FIG. 7.

Next, the passage unit 140 and the actuator unit 120 will be described with reference to FIG. 7. FIG. 7 is a plan view of the passage unit 140. FIG. 8 is an enlarged plan view of a region enclosed with an alternate long and short dash line in FIG. 7. In FIG. 8, for the purpose of explanatory convenience, the actuator units 120 are illustrated with alternate long and two short dashes lines, while apertures 12, nozzles 8, and the like which are formed within the passage unit 140 or on the lower face of the passage unit 140 and therefore should actually be illustrated with broken lines are illustrated with solid lines.

As shown in FIG. 7, in a plan view, the passage unit 140 has a rectangular shape with its longer side extending in parallel with the main scanning direction. Actuator units 120 are mounted on the upper face of the passage unit 140. The actuator unit 120 has a trapezoidal shape, and disposed in such a manner that a pair of its parallel opposed sides extend in parallel with the main scanning direction. Four actuator units 120 are arranged in a zigzag pattern in the main scanning direction. Oblique sides of every neighboring ones of the four actuator units 120 partially overlap each other with respect to the sub scanning direction.

On the upper face of the passage unit 140, five recesses (i.e., grooves) 141 are formed in the vicinity of each widthwise end of the passage unit 140. The recesses 141 extend from the upper face of the passage unit 140, halfway through a thickness of the passage unit 140. The recesses 141 are formed at positions corresponding to the five projections 150*b* of the heat sink 150. The recess 141 has a size and a shape just-fittable with the projection 150*b* of the heat sink 150. As shown in FIG. 7, the recesses 141 are paired corresponding to bottom bases (which means longer ones of the parallel opposed sides) of the actuator units 120. This can prevent lateral displacement of the side plate 153 which may otherwise be caused by pressing force applied by the rib 113 to the opposing plate 154 of the heat sink 150. Thus, at least near the actuator unit 120, highly close contact between the heat sink 150 and the passage unit 140 is ensured.

Manifold channels 5, which are a part of ink passages, are formed within the passage unit 140. Several ink supply ports 140*a* are formed on the upper face of the passage unit 140. Each manifold channel 5 has its one end communicating with each of the ink supply ports 140*a*. There are a total of ten ink supply ports 140*a* that are arranged five by five along the longitudinal direction of the passage unit 140. The ink supply ports 140*a* are provided at positions away from where the four actuator units 120 are disposed.

As shown in FIG. 8, several sub manifold channels 5*a* are branched from the manifold channel 5 formed within the passage unit 140. The passage unit 140 has pressure chamber groups 9 in each of which pressure chambers 10 are formed in a matrix. Each pressure chamber 10 is a hollow region having a substantially rhombic shape in a plan view. The pressure chambers 10 are formed so as to open on the upper face of the passage unit 140. The pressure chambers 10 are arranged on the upper face of the passage unit 140, substantially throughout an entire region opposed to the actuator unit 120.

In this embodiment, sixteen pressure chamber rows, in each of which pressure chambers 10 are arranged at regular intervals in the longitudinal direction of the passage unit 140, are disposed in parallel to each other in the widthwise direction of the passage unit 140. The number of pressure chambers 10 included in each pressure chamber row is, in conformity with a contour of the actuator unit 120, gradually reduced from a longer side to a shorter side of the actuator unit 21. Nozzles 8 are arranged in the same manner.

Figure 9:
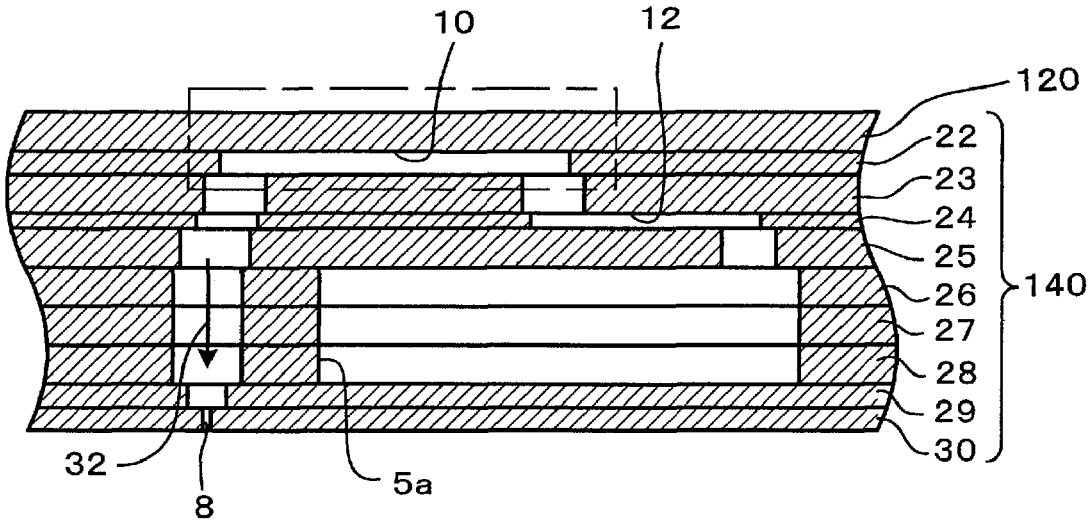
FIG. 9 shows a longitudinal cross section as taken along line IX-IX in FIG. 8.
Figure 10:
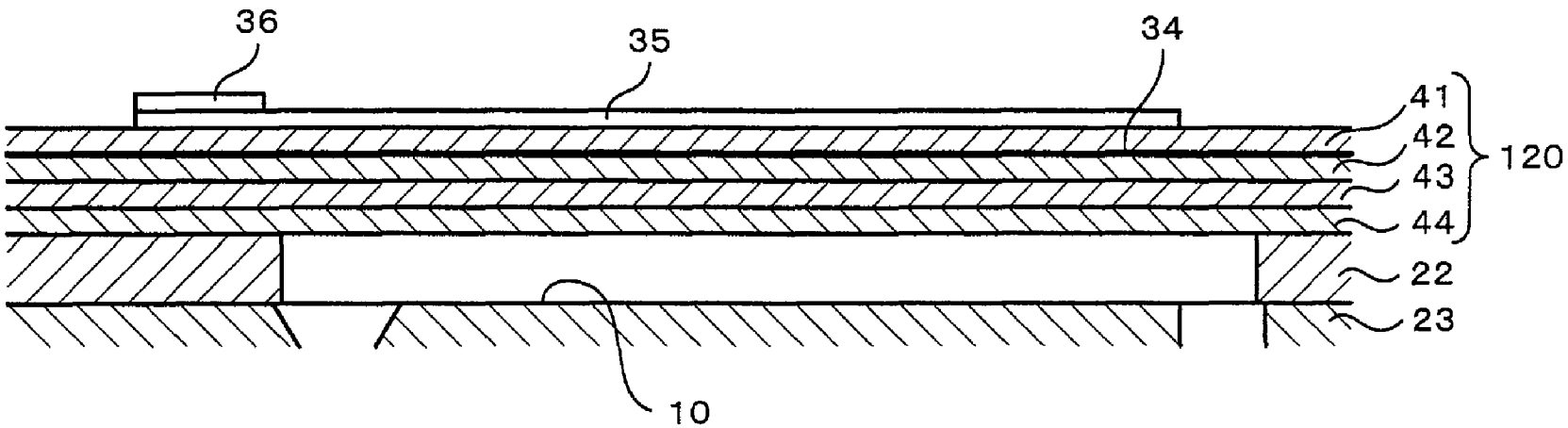
FIG. 10 is an enlarged view of a region enclosed with an alternate long and short dash line in FIG. 9.

Cross-sectional constructions of the passage unit 140 and the actuator unit 120 will be described with reference to FIGS. 9 and 10. FIG. 9 shows a longitudinal cross section as taken along line IX-IX in FIG. 8. FIG. 10 is an enlarged view of a region enclosed with an alternate long and short dash line in FIG. 9.

As shown in FIG. 9, the passage unit 140 has a layered structure laminated with plates. The plates are, from the upper face of the passage unit 140, a cavity plate 22, a base plate 23, an aperture plate 24, a supply plate 25, manifold plates 26, 27, 28, a cover plate 29, and a nozzle plate 30. Many communication holes are formed in these plates. The plate are positioned and laminated with each other in such a manner that the communication holes communicate with each other so as to form individual ink passages 32 and sub manifold channels 5*a*. Like this, many individual ink passages 32 each including an aperture 12, a pressure chamber 10, and a nozzle 8 are formed within the passage unit 140. A lower face of the passage unit 140 is made an ink ejection face on which nozzles 8 are opened. Each individual ink passage 32 communicates with the sub manifold channel 5*a*. Ink supplied to the manifold channels 5 is supplied through the sub manifold channels 5 to the respective individual ink passages 32.

As shown in FIG. 10, the actuator unit 120 has a layered structure laminated with four piezoelectric layers 41, 42, 43, and 44. The piezoelectric layers 41 to 44 are made of a lead zirconate titanate (PZT)-base ceramic material having ferroelectricity.

The actuator unit 120 has individual electrodes 35 and a common electrode 34 that are made of a metal material such as Ag—Pd-base one. A shape of the individual electrode 35 is substantially similar to but a little smaller than that of the pressure chamber 10. The individual electrode 35 is disposed on an upper face of the actuator unit 120 so as to fall within a region opposed to the pressure chamber 10 (see FIG. 8). One end of the individual electrode 35 extends out beyond the region opposed to the pressure chamber 10, and provided with a land 36. The land 36 is made for example of gold including glass frits, and has a protruding shape. The land 36 is electrically connected to each wire 162*a* of the FPC 162.

The common electrode 34 is interposed between the piezoelectric layer 41 and the piezoelectric layer 42, substantially throughout an entire face in a plan direction. That is, the common electrode 34 extends over all of pressure chambers 10 that exist in the region opposed to the actuator unit 120. The common electrode 34 is grounded in a not-shown region, and held at the ground potential. The individual electrodes 35 and the common electrode 34 are disposed so as to sandwich only the uppermost piezoelectric layer 41 therebetween. Only regions of the piezoelectric layer 41 sandwiched between the respective individual electrodes 35 and the common electrode 34 act as active portions. That is, the actuator unit 120 has a so-called unimorph type structure.

When the driver IC 160 selectively supplies a predetermined voltage pulse through the wire 162*a* of the FPC 162 to an individual electrode 35, a region of the actuator unit 120 corresponding to this individual electrode 35 deforms to thereby change a volume of a pressure chamber 10 that correspond to the region. As a result, a pressure wave is caused on ink contained in the pressure chamber 10, so that an ink droplet is ejected through a corresponding nozzle 8.

In the ink-jet head 100 of this embodiment described above, the distal end portion 113*a* of the head covering 110 abuts on the opposing plate 154 of the heat sink 150, thereby bringing the lower end face of the side plate 153 of the heat sink 150 into sure contact with the passage unit 140. Consequently, no gap appears between the passage unit 140 and the side plate 153. Therefore, a splash of ink cannot go through a gap between the passage unit 140 and the side plate 153 so that a splash of ink is prevented from adhering to the actuator unit 120. Accordingly, even when there is an error in positional relation between the opposing plate 154 and the distal end portion 113*a* of the head covering 110 due to a manufacturing tolerance of the head covering 110 and/or the heat sink 150 or the like, the side plate 153 can be surely in contact with the mounting face of the passage unit 140 by bringing the distal end portion 113*a* into sure contact with the opposing plate 154.

In addition, the distal end portion 113*a* of the head covering 110 presses the opposing plate 154 of the heat sink 150 so as to elastically deform the heat sink 150 in a region between the head covering 110 and the passage unit 140. Thus, by elastic resilient force of the heat sink 150, the side plate 153 is biased toward the upper face of the passage unit 140. This can surely bring the side plate 153 into contact with the upper face of the passage unit 140.

Moreover, since the driver IC 160 is in close contact with the metal-made heat sink 150 with the heat dissipation sheet 156 interposed therebetween, the driver IC 160 and the heat sink 150 are thermally coupled to each other. Thus, the heat sink 150 serves both as a side plate of the ink-jet head 100 and as a heat sink for the driver IC 160, the ink-jet head 100 can be downsized.

Besides, since the boundary region between the side plate 153 of the heat sink 150 and the upper face of the passage unit 140 is sealed with the potting material 155, a splash of ink can be surely prevented from going through between the passage unit 140 and the lower end face of the side plate 153.

Further, rigidity of the head covering 110 is improved, because the head covering 110 has the ribs 113.

Further, the distal end portion 113*a* of the rib 113, which presses the opposing plate 154, has a curved contour in its cross section including the axis in the protruding direction of the rib 113. Therefore, contact between the distal end portion 113*a* and the opposing plate 154 occurs in a very small area. Accordingly, accuracy of a contact position is improved, so that respective distal end portions 113*a* can present uniform contact force.

Since the distal end portion 113*a* of the rib 113 provided on the head covering 110 presses the end portion of the opposing plate 154 distant from its connection points, the opposing plate 154 is elastically deformed toward the passage unit 140. This enables the distal end portion 113*a* to be surely in contact with the opposing plate 154, even when the opposing plate 154 and the distal end portion 113*a* are largely out of position due to a manufacturing tolerance of the head covering 110 and/or the heat sink 150 or the like.

Since the opposing plate 154, which is pressed by the distal end portion 113*a* of the rib 113, is opposed to the actuator unit 120, it is difficult that a gap appears between the passage unit 140 and the side plate 153 in a region closest to the actuator unit 120.

Since the outer face of the side plate 153 and the inner face of the side plate 112 of the head covering 110 are in contact with each other, the side plate 153 is prevented from bending outward and at the same time contact between the side plate 153 and the side plate 112 is improved. Therefore, a splash of ink does not go through between the side plate 153 and the side plate 112. In addition, since the side plate 112 restricts outward elastic deformation of the side plate 153, the side plate 153 is biased toward the upper face of the passage unit 140 with larger force. This makes it more difficult that a gap appears between the passage unit 140 and the side plate 153.

Since the projections 150*b* of the heat sink 150 are fitted in the recesses 141 formed on the upper face of the passage unit 140, the heat sink 150 is not easily inclined and thus a positional shift can be restrained. Therefore, the heat sink 150 can surely receive pressing force given by the distal end portion 113*a*. This makes it further more difficult that a gap appears between the passage unit 140 and the heat sink 150. Besides, since a position for mounting the heat sink 150 on the passage unit 140 can be seen clearly and accurately, the ink-jet head 100 can be assembled easily.

A certain preferred embodiment of the present invention has been described above. However, the present invention is not limited to the above-described embodiment. Various changes may be made without departing from the scope of the invention as defined in the claims. For example, although in the above-described embodiment the heat sink 150 is made of a metal material and thermally coupled to the driver IC 160, the heat sink 150 may be made of a material different from metal materials and may not be thermally coupled to the driver IC 160.

In addition, although in the above-described embodiment the boundary region between the side plate 153 of the heat sink 150 and the upper face of the passage unit 140 is sealed with the potting material 155, it may not be sealed with the potting material 155.

Moreover, although in the above-described embodiment the opposing plate 154 is pressed by the distal end portion 113*a* of the rib 113 provided on the head covering 110, it may also be possible that a rib does not have the distal end portion 113*a* and that a rib is not provided on a head covering. In such a case, it suffices that the opposing plate 154 is pressed by another portion of the head covering.

In the above-described embodiment, besides, the distal end portion 113*a* of the rib 113, which presses the opposing plate 154, has a curved contour in its cross section including the axis in the protruding direction of the rib 113. However, a distal end portion may have any arbitrary shape. For example, a distal end portion may have a rectangular shape.

In the above-described embodiment, further, the distal end portion 113*a* of the rib 113 presses the end portion of the opposing plate 154 distant from its connection points. However, it may be also possible that the distal end portion 113*a* of the rib 113 presses any arbitrary portion of the opposing plate 154.

In the above-described embodiment, further, the opposing plate 154, on which the distal end portion 113*a* of the rib 113 abuts, is opposed to the actuator unit 120. However, an opposing plate may not be opposed to the actuator unit 120.

In the above-described embodiment, further, the outer face of the side plate 153 of the heat sink 150 and the inner face of the side plate 112 of the head covering 110 are in contact with each other. However, the outer face of the side plate 153 may be in contact with a member other than the side plate 112, and the outer face of the side plate 153 may be in contact with none of the members.

In the above-described embodiment, further, the five projections 150*b* of the heat sink 150 are fitted in the respective recesses 141 formed on the upper face of the passage unit 140. However, the number of projections of a heat sink may be arbitrary, and moreover a heat sink may not necessarily have a projection. In such a case, it may be possible that a side plate of the heat sink is, in its entire lower end portion, fitted in a groove formed on an upper face of a passage unit.

In the above-described embodiment, further, the lower end face of the side plate 153 of the heat sink 150 is in contact with the upper face of the passage unit 140 in such a manner as to perpendicularly cross the upper face of the passage unit 140. However, a lower end face of a side plate may be in contact with the upper face of the passage unit 140 at an angle other than a perpendicular angle.

In the above-described embodiment, further, the distal end portion 113*a* of the head covering 110 presses the opposing plate 154 of the heat sink 150 so that the heat sink 150 is elastically deformed in the region between the head covering 110 and the passage unit 140. However, it may be possible that the distal end portion 113*a* of the head covering 110 is merely in contact with the opposing plate 154 of the heat sink 150 so that the heat sink 150 is not elastically deformed in the region between the head covering 110 and the passage unit 140.

In the above-described embodiment, further, the head covering 110 presses both of the two heat sinks 150 toward the passage unit 140. However, the head covering 110 may press only one of the heat sinks 150. In such a case, a splash of ink does not go through between the passage unit 140 and at least the heat sink 150 pressed by the head covering 110. Alternatively, it may be also possible to provide only a single heat sink 150 and make the single heat sink 150 pressed by the head covering 110.

While this invention has been described in conjunction with the specific embodiments outlined above, it is evident that many alternatives, modifications and variations will be apparent to those skilled in the art. Accordingly, the preferred embodiments of the invention as set forth above are intended to be illustrative, not limiting. Various changes may be made without departing from the spirit and scope of the invention as defined in the following claims.

What is claimed is:

1. An ink-jet head comprising:

a passage unit having an ink ejection face on which a plurality of ink ejection ports that eject ink droplets are formed;

an actuator that is mounted on a mounting face of the passage unit which is opposite to the ink ejection face, and generates ejection energy for ejecting ink droplet from the ink ejection port;

at least one side plate member having a side plate and a confronting plate, the side plate extending in a longitudinal direction of the passage unit along a contour line of the passage unit and being in contact with the mounting face at a position between an outer edge of the mounting face and the actuator in such a manner as to perpendicularly cross the mounting face, the confronting plate being connected to the side plate and confronting the mounting face; and a cover member placed at such a position that the actuator and the side plate member are sandwiched between the cover member and the passage unit, relative to the direction to perpendicularly cross the mounting face., wherein the cover member is disposed so as to press the confronting plate of the side plate member toward the passage unit, relative to the direction to perpendicularly cross the mounting face.

2. The ink jet head according to claim 1, wherein the side plate member is elastically deformed in its region between the cover member and the passage unit.

3. The ink jet head according to claim 1, further comprising a driver IC that drives the actuator, wherein:

the side plate member is made of a metal material; and the driver IC and the side plate member are thermally coupled to each other.

4. The ink jet head according to claim 1, wherein a boundary region between the mounting face and the side plate of the side plate member is sealed with a potting material.

5. The ink jet head according to claim 1, wherein:

a rib protruding toward the mounting face is formed on a face of the cover member opposed to the mounting face; and a distal end of the rib abuts on the opposing plate.

6. The ink jet head according to claim 5, wherein the distal end of the rib has, in its cross section including an axis in a protruding direction of the rib, a curved contour.

7. The ink-jet head according to claim 5, wherein the distal end of the rib abuts on a distal end portion of the opposing plate which is away from the side plate.

8. The ink-jet head according to claim 5, wherein the side plate member is formed in such a manner that a region of the opposing plate on which the distal end of the rib abuts is opposed to the actuator.

9. The ink-jet head according to claim 1, wherein:

the cover member has a cover side plate that extends toward one widthwise end portion of the passage unit; and the cover side plate is in contact with a face of the side plate opposite to a face thereof to which the opposing plate is connected.

10. The ink-jet head according to claim 1, wherein:

the passage unit has at least two grooves that extend from the mounting face halfway through a thickness of the passage unit;

the side plate has a contact face that is contactable with the mounting face and projections that project from the contact face, the number of the projections being equal to the number of the grooves; and the projections are fitted in the respective grooves.

11. The ink jet head according to claim 1, wherein the side plate has a protrusion that protrudes in a widthwise outward direction of the passage unit and extends along the longitudinal direction of the passage unit, and the side plate is in perpendicular contact with the mounting face.

12. The ink jet head according to claim 1, wherein:

two side plate members are provided; and the two side plate members are disposed at one widthwise end portion and the other widthwise end portion of the passage unit, respectively.

13. The ink jet head according to claim 1, wherein:

an ink reservoir that supplies ink to the passage unit is placed between the passage unit and the cover member;

the cover member and the ink reservoir respectively have opposing regions that are opposed to each other with respect to at least either one of widthwise and longitudinal directions of the passage unit;

a plurality of recesses are formed in the opposing region of the ink reservoir; and a plurality of projections fitted in the recesses are formed in the opposing region of the cover member.

* * * * *